US011141619B2

(12) United States Patent
Liu et al.

(10) Patent No.: US 11,141,619 B2
(45) Date of Patent: Oct. 12, 2021

(54) SPINNER BIKE WITH ADJUSTABLE MAGNETIC RESISTANCE

(71) Applicant: CHI HUA FITNESS CO., LTD., Hsinchu County (TW)

(72) Inventors: Yuan-Pin Liu, Hsinchu County (TW); Shang-Ta Wu, Hsinchu County (TW)

(73) Assignee: Chi Hua Fitness Co., Ltd., Hsinchu County (TW)

( * ) Notice: Subject to any disclaimer, the term of this patent is extended or adjusted under 35 U.S.C. 154(b) by 0 days.

(21) Appl. No.: 16/928,316

(22) Filed: Jul. 14, 2020

(65) Prior Publication Data

US 2020/0338383 A1 Oct. 29, 2020

Related U.S. Application Data

(63) Continuation-in-part of application No. 16/256,087, filed on Jan. 24, 2019, now abandoned.

(30) Foreign Application Priority Data

Nov. 13, 2018 (TW) ..... 107215394

(51) Int. Cl.

| | |
|---|---|
| ***A63B 21/005*** | (2006.01) |
| ***A63B 21/22*** | (2006.01) |
| ***A63B 21/00*** | (2006.01) |
| ***A63B 71/06*** | (2006.01) |
| ***A63B 22/06*** | (2006.01) |

(52) U.S. Cl.

CPC .... *A63B 21/0051* (2013.01); *A63B 21/00069* (2013.01); *A63B 21/154* (2013.01); *A63B 21/225* (2013.01); *A63B 22/0605* (2013.01); *A63B 71/0622* (2013.01); *A63B 2220/24* (2013.01); *A63B 2220/833* (2013.01)

(58) Field of Classification Search

CPC . A63B 21/0051; A63B 21/225; A63B 21/154; A63B 21/00069; A63B 71/0622; A63B 22/0605; A63B 2220/833; A63B 2220/24; A63B 2071/0675; A63B 2071/009; A63B 21/0055; A63B 71/0619; A63B 2220/16; A63B 2071/065; A63B 2220/80; A63B 21/00192; A63B 71/0054; A63B 2209/08

See application file for complete search history.

(56) References Cited

U.S. PATENT DOCUMENTS

| | | | | |
|---|---|---|---|---|
| 6,084,325 A * | 7/2000 | Hsu | A63B 21/0051 188/161 |
| 10,398,933 B2 * | 9/2019 | Crist | A63B 22/0023 |
| 2017/0304667 A1 * | 10/2017 | Chou | A63B 24/0087 |

* cited by examiner

*Primary Examiner* — Nyca T Nguyen
*Assistant Examiner* — Andrew M Kobylarz
(74) *Attorney, Agent, or Firm* — Rosenberg, Klein & Lee

(57) ABSTRACT

A spinner bike with adjustable magnetic resistance includes a generator, a disc plate, a magnetic resistance adjusting apparatus and a resistance adjusting apparatus. The elements are disposed on a frame body of a spinner bike, so that a pedaling mechanism of the spinner bike can be operated to drive a flywheel and the disc plate for generating electricity by the cutting of flux formed by a plurality of magnets surrounding an armature core. Rotating a button of the resistance adjusting apparatus enables a connecting rod operating a pulling cable, so as to further alter coverage of the flux on the disc plate for adjustment of the loading resistance.

4 Claims, 15 Drawing Sheets

100

SPINNER BIKE WITH ADJUSTABLE MAGNETIC RESISTANCE

This patent application is a continuation-in-part of Ser. No. 16/256,087 filed on Jan. 24, 2019.

BACKGROUND OF THE INVENTION

1. Field of the Invention

The invention relates to a spinner bike with adjustable magnetic resistance, particularly to one that controls coverage of magnetic flux on a disc plate to smoothly adjust the loading resistance of the spinner bike.

2. Description of the Related Art

With reference to FIG. 1, conventionally, a spinner bike 910 has a braking element 912 disposed aside a flywheel 911 to produce a braking force. The braking element 912 engages an end of a connector 913 which has the other end connected to an end of a cable 914. The cable 914 has the other end connected to a brake controller 915. A braking force is produced when the brake controller 915 pulls the cable 914 to rotate the connector 913 and force the braking element 912 to contact with the flywheel 911 for producing friction. However, such braking device cannot afford intense and constant frictions and the components are rapidly consumed due to wear and tear. Also, a strong smell is produced in the braking operation due to the friction contact.

FIG. 2 illustrates a magnetically controlled loading device 930. Such device can avoid the intense and constant frictions and the bad smell produced in spinner bikes such as the one in FIG. 1. The magnetically controlled loading device 930 has a magnetic board 931 placed near an inner periphery of a flywheel device 933 and has a gap G formed in-between the magnetic board 931 and the flywheel device 933. By pulling a cable 935, the magnetic board 931 has a free end thereof radially displaced and the area of the gap G is altered; the loading device 930 is therefore able to adjust the loading force produced by the operation. However, such loading devices cannot reduce the loading force to zero since it is fixed to the loading device 930 at a fixed section 937 and the magnetic field created by the operation would not depart from the loading device 930.

The applicant own a US Patent related to this application, U.S. Pat. No. 6,084,325, it disclosed a brake device with a combination of power-generating and eddy-current magnetic resistance having an outer]-shaped fly wheel fastened on a central axle of a frame and fitted with a permanent magnet on the inner circular edge to form a rotor type, and the fly wheel is connected with a stator core fastened on the frame; moreover, one end of the central axle is stretching out of the frame and fitted with a belt wheel; the front end of the frame is fitted with a brake core adjacent to the outer edge of the fly wheel to supply a planned eddy current magnetic resistance to the fly wheel; in accordance with such design, the device generates power by means of the exercise force of users to drive the fly wheel to rotate, after passing through a DC power supply, it provides display & controlling gage with power source so that the power-generating and the eddy current magnetic resistance are integrated to reach the effect of reducing the volume and the producing cost. However, said patent did not disclose the design of magnet nor resistance adjusting apparatus.

US Pub. No. 2017/0304667 A1 is also own by the applicant, disclosed a brake controller for spinner bikes has a frame body engaging a pair of connecting pieces, a shaft engaging a first block through a top end thereof and a second block through a bottom end thereof, and a magnetic encoder that has a PCB with coding circuit for detecting rotation of a magnet disposed under the second block. Thereby the brake controller controls two kinds of braking forces by a single button for spinner bikes. However, said patent did not disclose the design of magnet nor resistance adjusting apparatus.

U.S. Pat. No. 10,398,993 B2 disclose an exercise apparatus includes a resistance system which has a first rotating shaft, a second rotating shaft and a transmission mechanism mounted between the two rotating shafts, such that the two rotating shafts are rotated with respect to each other at a predetermined transmission ratio. Besides, a first resistance device is controlled to apply a first resistance against rotation of the first rotating shaft, and a second resistance device is controlled to apply a second resistance against rotation of the second rotating shaft. The first resistance device and the second resistance device can be controlled independently. When a user uses the exercise apparatus to perform exercise, a moving member is driven by movement of the user. When the moving member is moved, the two rotating shafts are driven to rotate simultaneously, namely the user has to overcome the rotational resistance of the two rotating shaft during exercise; However, it did not disclose the structure of combination of disc plate and the generator nor the structure of magnetic resistance adjusting apparatus

SUMMARY OF THE INVENTION

A primary objective of the present invention is to provide a spinner bike that is able to adjust a loading resistance for operation.

Another objective of the present invention is to provide a spinner bike that is able to smoothly adjust a loading resistance from a minimum to a maximum.

Yet another objective of the present invention is to provide a spinner bike that has a generator to produce electricity power for an interface on the spinner bike to display numbers of loading resistance.

To achieve the objectives above, the present invention comprises a frame body including a pedaling mechanism and a handler bar; an electricity generator disposed at a rear side of said frame body, including a fixing element, a circular armature core surrounding said fixing element, a rotating element having an axis engaging a fourth pulley wheel and an axial seat engaging in a sleeve bush of a flywheel and a plurality of magnets disposed in an inner depression of said flywheel and surrounding said armature core, a gap arranged between said plurality of magnets and said armature core, so that when the flywheel is driven to rotate by the rotating element, the magnets and the armature core would produce electricity due to operation of cutting-of-flux; wherein the outer periphery of the flywheel has an external diameter d1 and an external diameter d2 to form an annular positioning surface, and the annular positioning surface has multiple first positioning holes; a disc plate made of magnetically conductive metal and disposed around an outer periphery of said flywheel to be rotated together with said flywheel; wherein the inner diameter D1 of the disc plate is larger or equal to the external diameter d1 of the flywheel but smaller than the external diameter d2 of the flywheel, the disc plate has multiple second positioning holes corresponding to the first positioning holes, and the disc plate is set on the outer periphery of the flywheel by several bolts; also, the external diameter D2 of the disc plate is larger than the external diameter d2 of the flywheel, and the external diameter D2 of the disc plate is at least 1.5 times larger than the external diameter d2 of the flywheel; a magnetic resistance adjusting apparatus disposed on said frame body at a front side of said disc plate, including a positioning element with a space arranged therein, a spindle hole arranged at a bottom thereof and a trench hole at a top thereof, a magnetically reluctant element fixed at a bottom of said positioning element by a positioning shaft and having a pair of symmetrical fixing plates positioned by a pivot element at the bottom, said pair of fixing plates arranged in a gap with a distance slightly greater than a thickness of said disc plate, each fixing plate having at least two magnets engaged at an inner side thereof, wherein the internal surface of the fixing plates having two circular convex surfaces, two magnets are arranged on both convex surfaces for making the magnets to be symmetric, and the arrangement linear angle of the magnets are correspond to the tangent angle of the disc plate in order to achieve coupling effectively; when the magnetically reluctant element is rotated to the lowest position, the pair of fixing plates would be positioned at lateral sides of the disc plate; when the magnetically reluctant element is rotated to the highest position, the pair of fixing plates would be separate from the disc plate; wherein a U shape fixing frame arrange at the inner periphery of fixing plates, and the middle of the U shape fixing frame has a slot with upward opening; wherein a pulling cable including a cable and a core wire inside the cable, the front end of the cable is positioned on the positioning element, the front end of the core wire set through the trench hole and connect to the rear side of the magnetically reluctant element, and a fixing block is set in the slot for pulling the magnetically reluctant element to drive the pivot element to rotate on the positioning shaft; moreover, at the outer periphery of the positioning shaft of the magnetic resistance adjusting apparatus has a spring element; thereby the magnetic flux of said magnets inside the pair of fixing plates would cover both side of the disc plate laterally when the pulling cable is not operated and a loading resistance at a maximum value is produced, and the magnetic flux of said magnets of the fixing plates would depart from the disc plate gradually and the loading resistance decreases gradually until returning to zero when the pulling cable is operated; and a resistance adjusting apparatus including a case body disposed at a front end of said frame body, a rotatable button, an operating rod connected to said button and an operating piece having a center thereof pivotally engaged to said case body by a pivot shaft and an end thereof pivotally engaged to the operating rod, a rear end of said inner cable of the pulling cable further fixedly tied up to a connecting rod, thereby the button is rotated to control the operating piece operated based on the pivot shaft and further have the connected rod operating the pulling cable for operation; whereby the pedaling mechanism is operated to rotate the rotating element for the flywheel and the disc plate to be driven for rotation and for the electricity generator to produce electricity, and the button is rotated for the connecting rod of the resistance adjusting apparatus to operate the pulling cable for the purpose of altering coverage area of magnetic flux produced by the operation and therefore adjusting a loading resistance of the spinner bike.

In addition, an interface is further installed on the handler bar and has electricity supply from the electricity generator, and a magnetic encoder with a magnet is further disposed at a bottom of the operating rod and a printed circuit board with encoding circuit is disposed below the magnet of the magnetic encoder, so that the printed circuit board is able to detect a rotation angle of the magnet and convert the rotation angle into a value of loading resistance displayed on the interface. A spring element is engaged outside the positioning shaft of the magnetic resistance adjusting apparatus so that when the connecting rod is operated and the pulling cable is driven thereby, the magnetically reluctant element rotates in a clockwise direction around the positioning shaft, when the connecting rod release the operational force on the pulling cable, the magnetically reluctant element therefore returns in a counter clockwise direction due to a torque force of the spring element.

In short, the present invention has following advantages:

1. The pedaling mechanism is operated to drive the rotating element of the electricity generator by the second belt and rotate the disc plate connected to the flywheel simultaneously. The magnetic resistance adjusting apparatus has magnetic flux covering the disc plate to produce the loading resistance for the pedaling mechanism. Therefore, controlling the coverage area of the magnetic flux on the disc plate enables adjustment of the loading resistance for the spinner bike.

2. The magnetically reluctant element is pivotally fixed on the positioning element by the positioning shaft. When the magnetically reluctant element is rotated to the lowest position, the pair of fixing plates would be positioned at lateral sides of the disc plate; when the magnetically reluctant element is rotated to the highest position, the pair of fixing plates would be positioned in the space of the positioning element. Furthermore, the resistance adjusting apparatus is activated to operate the pulling cable, causing the magnetic flux produced in a maximum value as the magnetic flux is fully covering the disc plate. Then the loading resistance would be gradually reduced as the magnetic flux is departing from the area of the disc plate until there is no overlapping area. In other words, the present invention is able to achieve a smooth adjustment of the loading resistance for the spinner bike.

3. The magnetic encoder disposed at the bottom of the operating rod in the resistance adjusting apparatus has the magnet and the PCB with encoding circuit. The PCB detects the rotation angle of the magnet to convert to a number of the loading resistance displayed on the interface, thereby allowing the users to obtain the information of the loading resistance instantly and to make further adjustments when needed.

DETAILED DESCRIPTION OF THE PREFERRED EMBODIMENT

Figure 1:
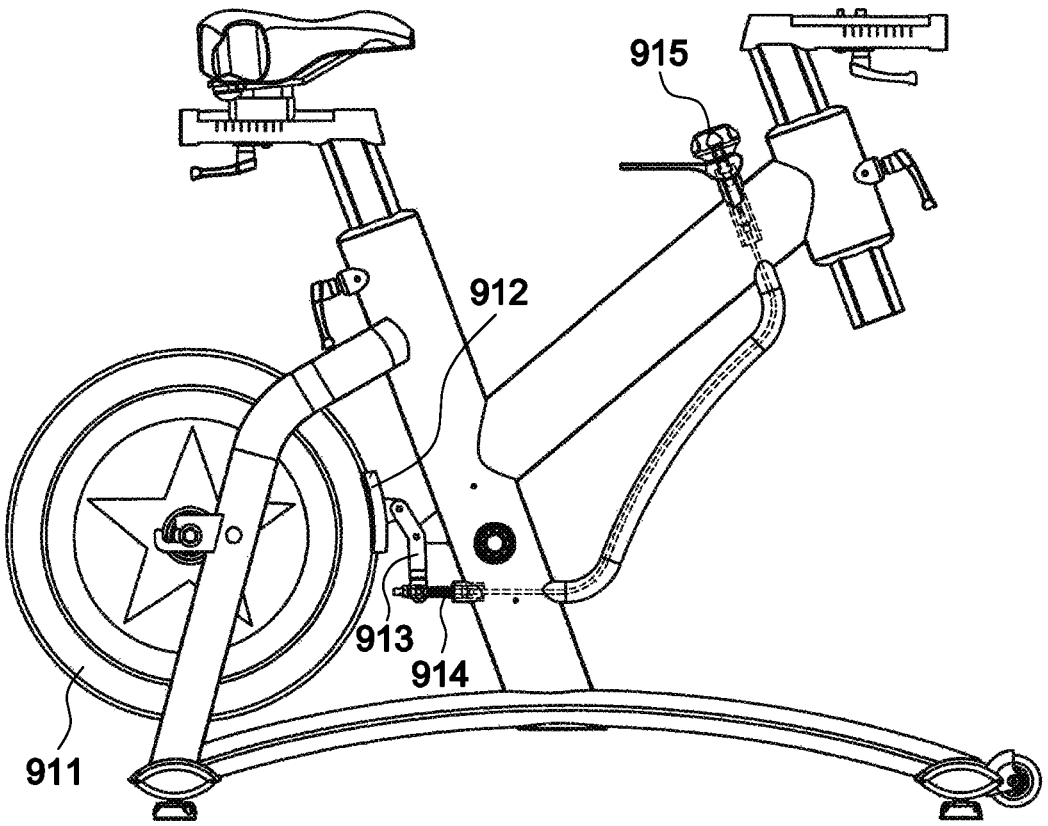
FIG.1 PRIOR ART
FIG. 1 is a schematic diagram illustrating a braking structure of a conventional spinner bike.
Figure 2:
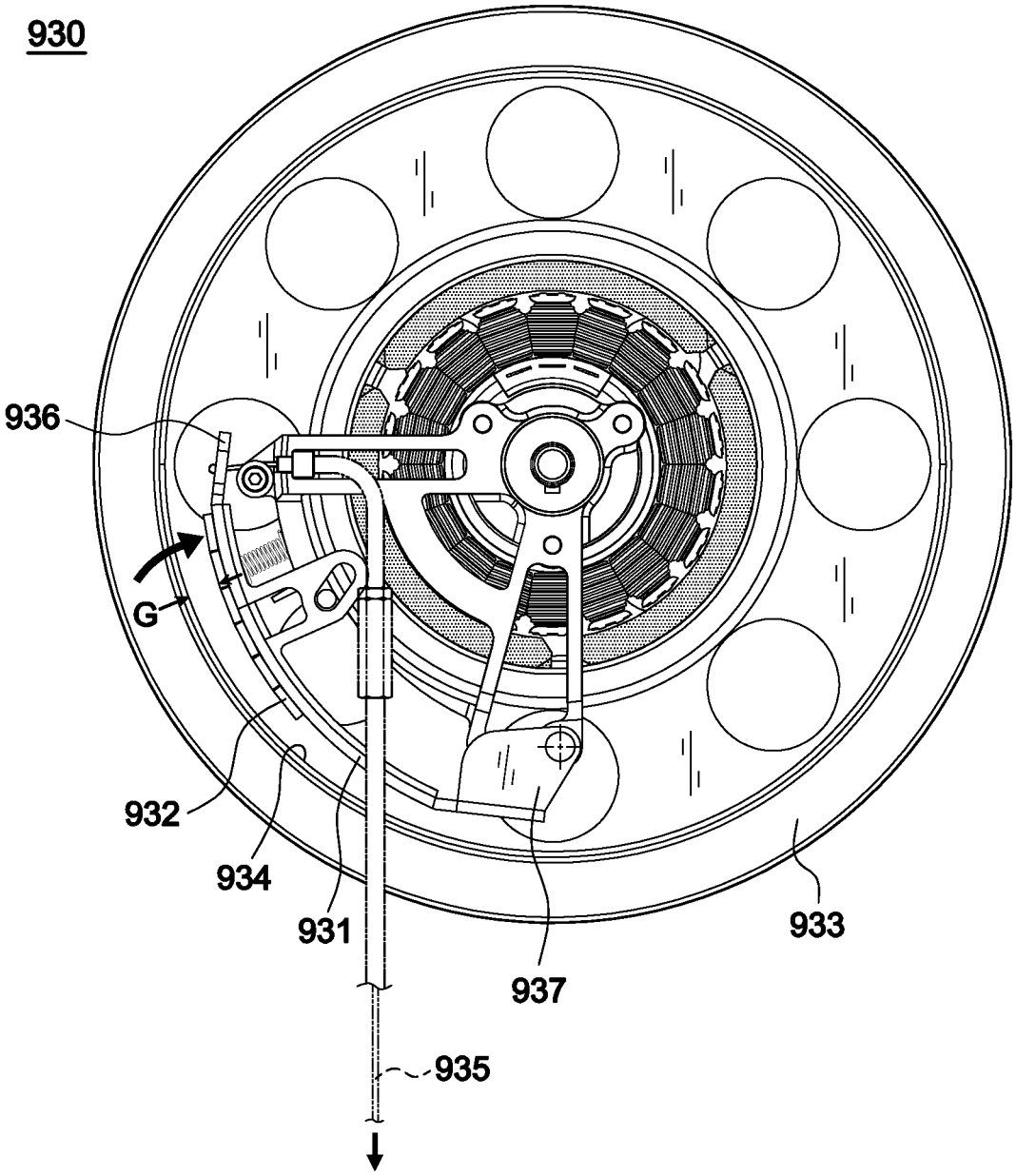
FIG.2 PRIOR ART
FIG. 2 is a schematic diagram illustrating a magnetic loading structure of a conventional spinner bike.
Figure 3:
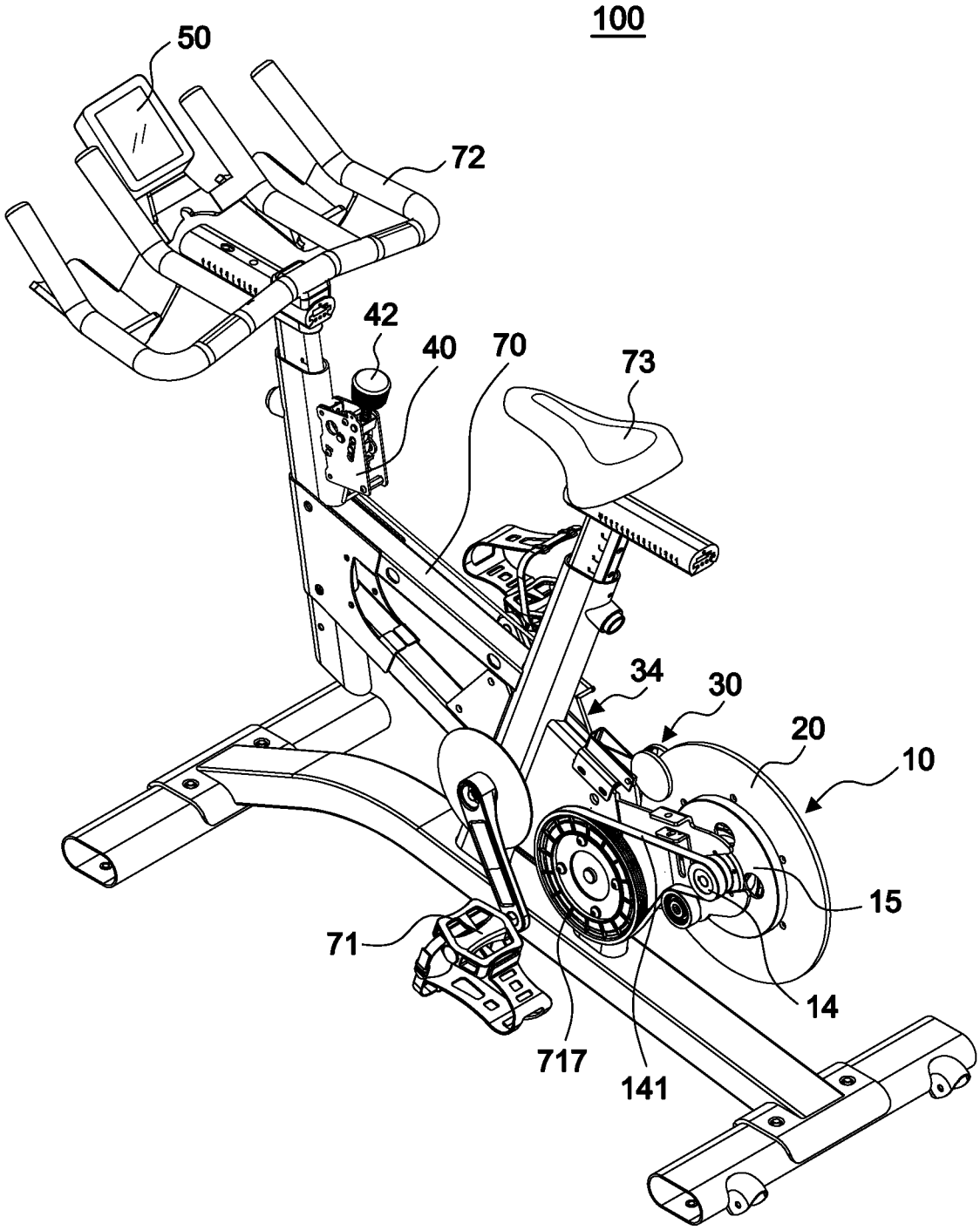
FIG. 3 is a perspective view of the present invention.
Figure 4:
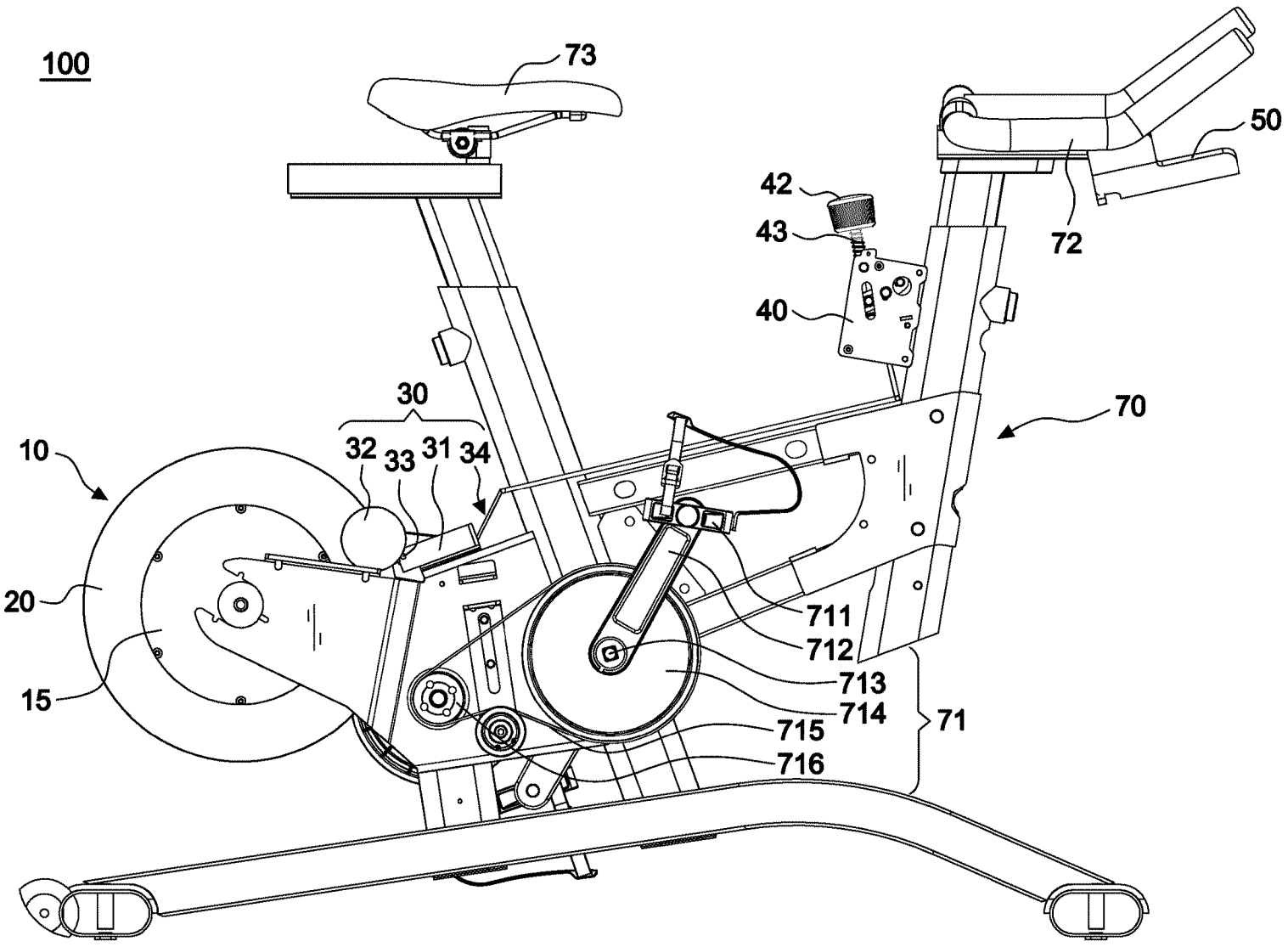
FIG. 4 is a right side elevation view of the present invention.
Figure 5A:
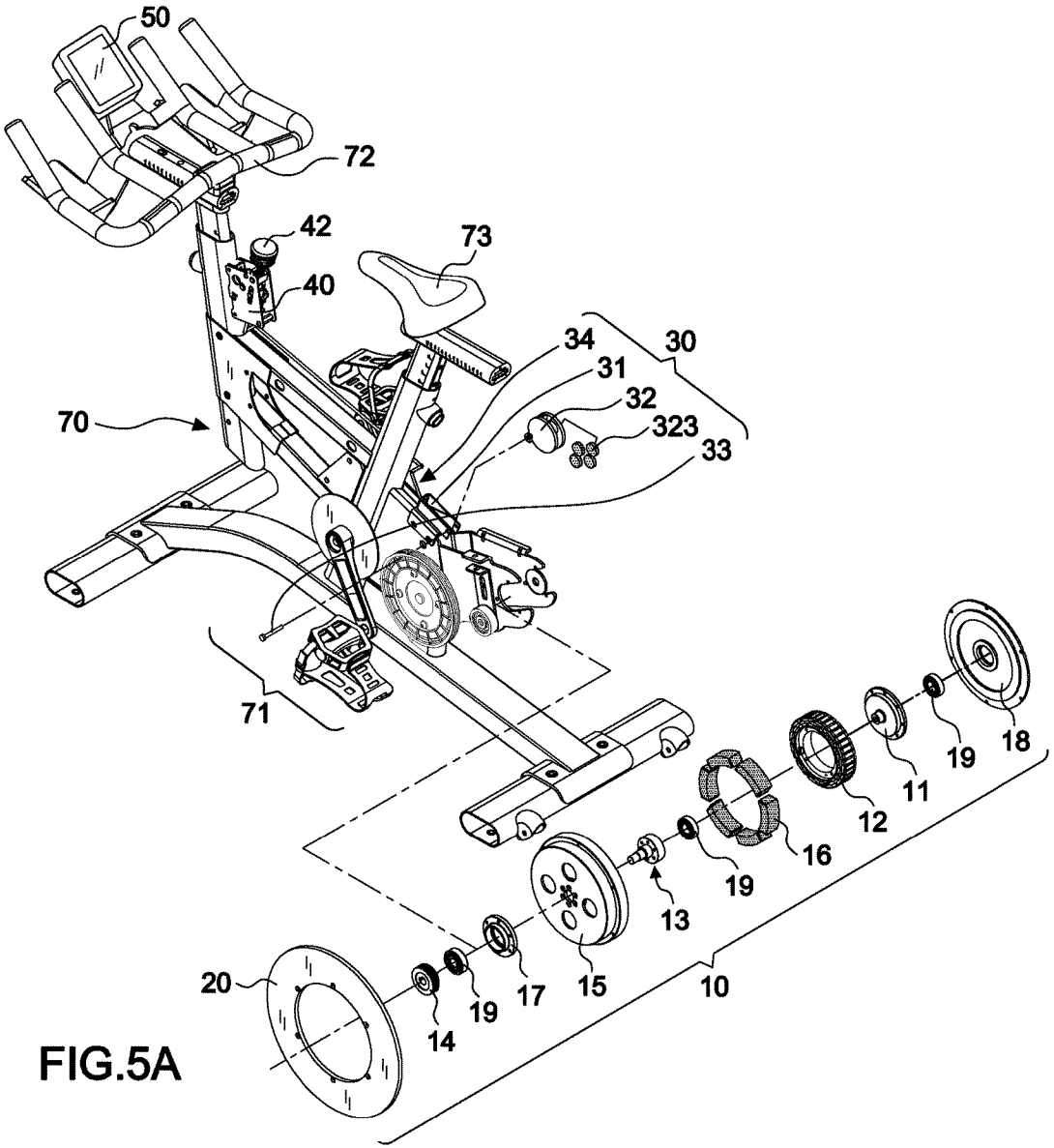
FIG. 5A is an exploded view of the present invention.
Figure 5B:
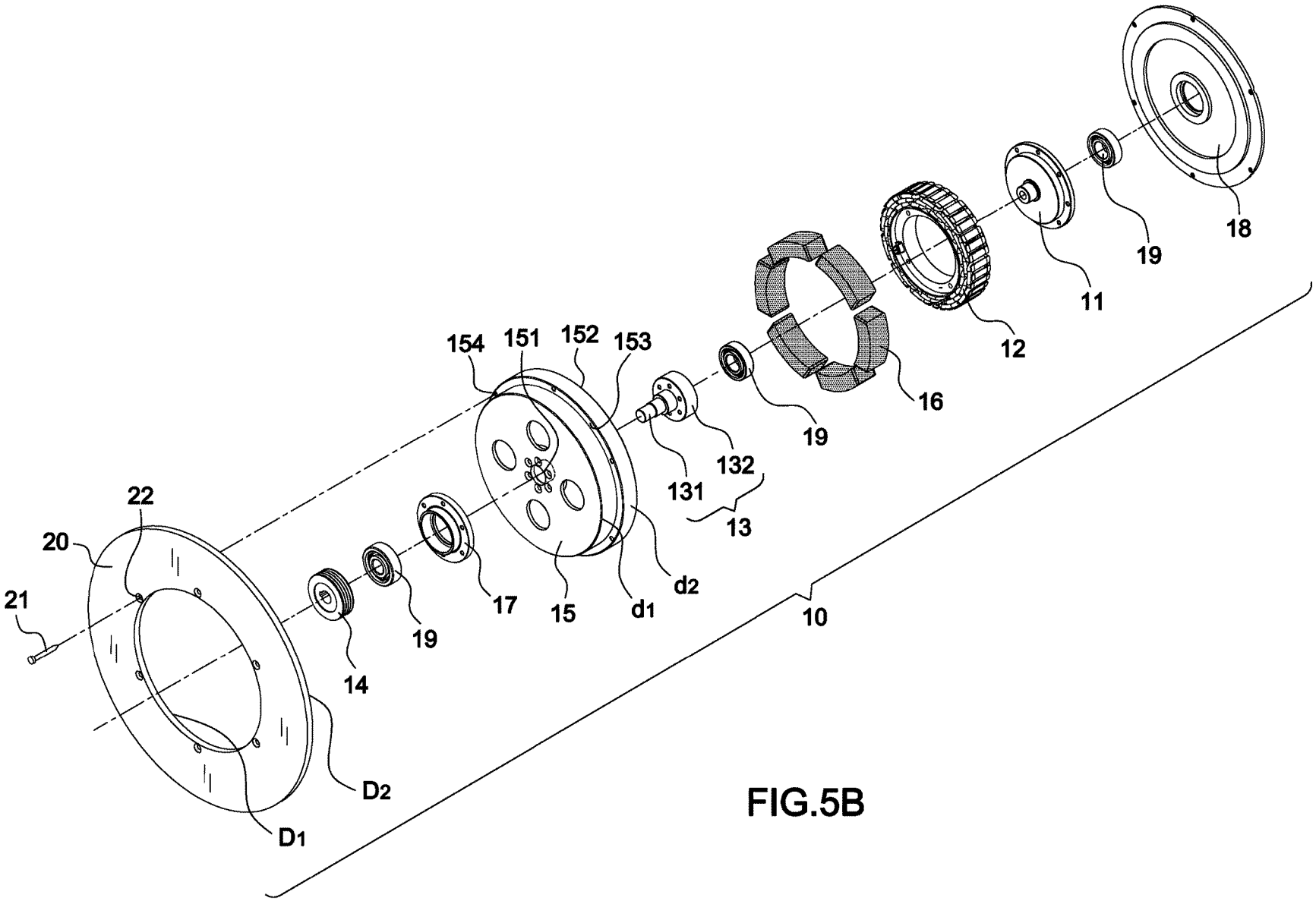
FIG. 5B is an exploded view of partial structure in FIG. 5A.

Referring to FIGS. 3-5, the present invention is a spinner bike with adjustable magnetic resistance 100, mainly including a frame body 70, an electricity generator 10, a disc plate 20, a magnetic resistance adjusting apparatus 30 a resistance adjusting apparatus 40 and an interface 50.

The frame body 70 includes a pedaling mechanism 71, a handler bar 72 and a seat 73. The pedaling mechanism 71 has a pair of pedals 711, each of which connected to a connecting piece 712 and driven by a pedal shaft 713. The pedal shafts 713 are further engaged to a first pulley wheel 714 that connects to a second pulley wheel 716 by a first belt 715 and drives the second pulley wheel 716 thereby. The second pulley wheel 716 is further connected to a third pulley wheel 717 which shares the same axis therewith. The diameter of the first pulley wheel 714 is greater than the one of the second pulley wheel 716, and the diameter of the second pulley wheel 716 is shorter than the one of the third pulley wheel 717. Therefore, the pedaling mechanism 71 is able to increase the rotation speed and reduce the torque force of the spinner bike by operation of the pedals 711 and the pedal shaft 713 transmitted to the third pulley wheel 717.

Figure 6A:
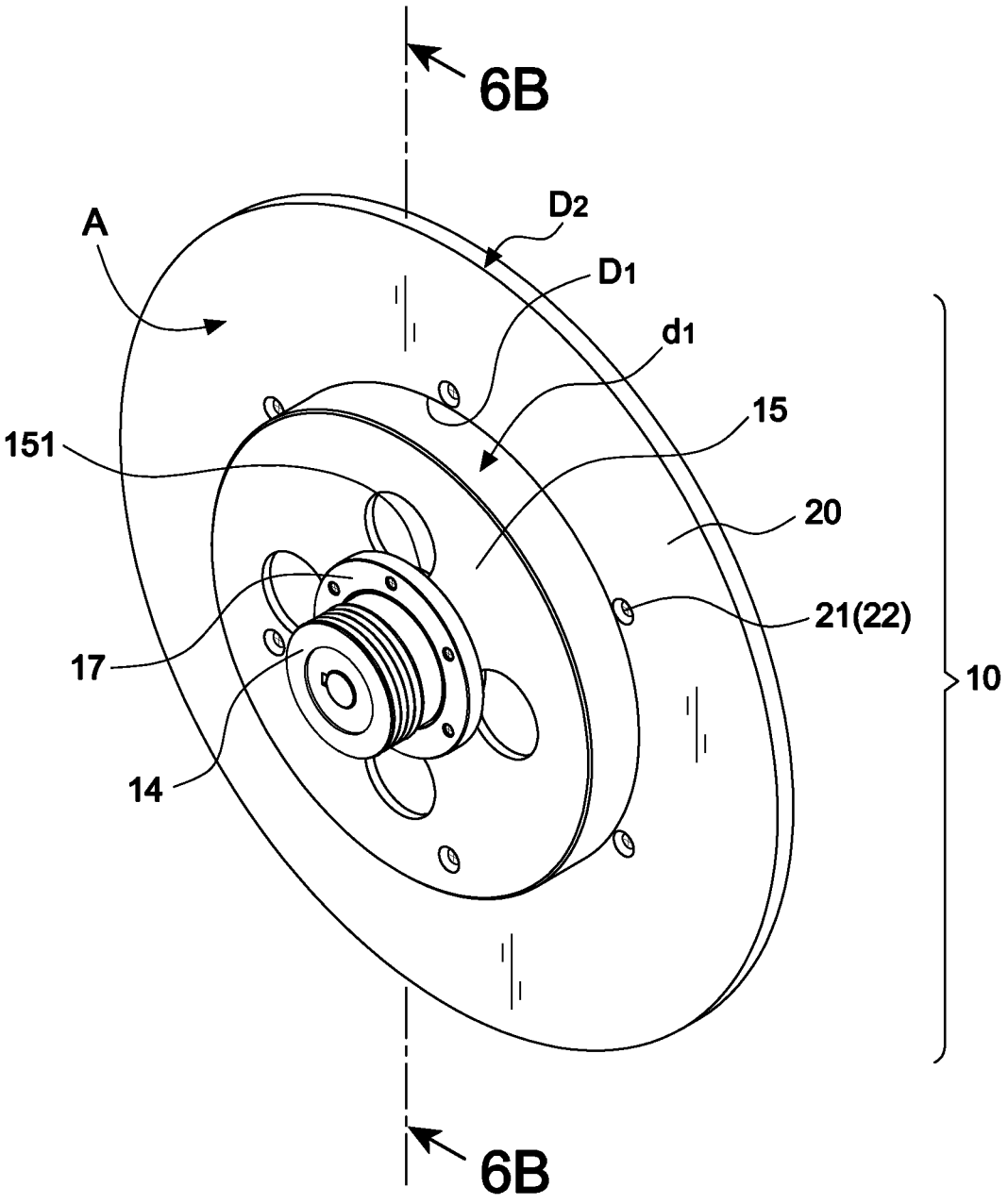
FIG. 6A is a perspective view of an electricity generator of the present invention.
Figure 6B:
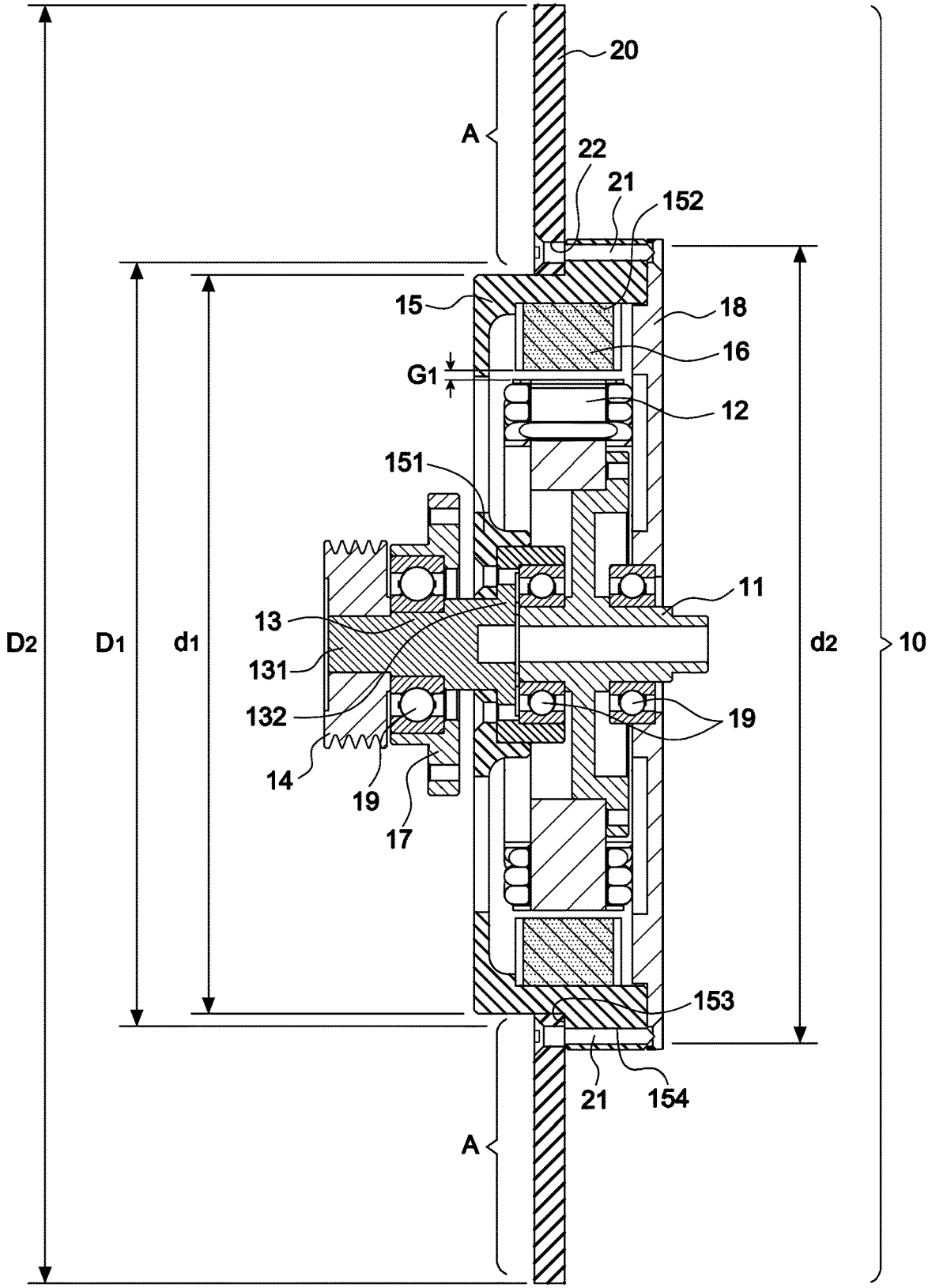
FIG. 6B is a sectional view of the electricity generator taken along line 6B-6B of FIG. 6A.

Referring to FIGS. 5A-6B, the electricity generator 10 is disposed at a rear side of the frame body 70 and includes a fixing element 11, a circular armature core 12 surrounding the fixing element 11, a rotating element 13 having an axis 131 engaging a fourth pulley wheel 14 and an axial seat 132 engaging in a sleeve bush 151 of a flywheel 15 and a plurality of magnets 16 disposed in an inner depression 152 of the flywheel 15 and surrounding the armature core 12; a gap G1 is arranged between the plurality of magnets 16 and the armature core 12, so that when the flywheel 15 is driven to rotate by the rotating element 13, the magnets 16 and the armature core 12 would produce electricity due to operation of cutting-of-flux. In the embodiment, the present invention further includes an interface 50 installed on the handler bar 72 and obtaining electricity supply from a circuit (not shown) of the electricity generator 10. An outer cap 18 is disposed at an outer side of the fixing element 11 to prevent the users from electricity shock and engaged with the flywheel 15 to be rotated therewith. The electricity generator 10 also includes a bearing cap 17 fixed on the frame body 70 and three bearings 19, one of which is disposed between the bearing cap 17 and the rotating element 13, another one of which is disposed between the fixing element 11 and the rotating element 13, and the other one of which is disposed between the fixing element 11 and the outer cap 18 as shown in FIGS. 5B and 6B.

The disc plate 20 is made of magnetically conductive metals such as aluminum and cooper and it is disposed around an outer periphery of the flywheel 15 to be rotated therewith, wherein the outer periphery of the flywheel 15 has an external diameter d1 and an external diameter d2 to form an annular positioning surface 153, and the annular positioning surface 153 has multiple first positioning holes 154; also, as FIGS. 6A and 6B showing, the disc plate 20 is in circular shape, wherein the inner diameter D1 of the disc plate 20 is larger or equal to the external diameter d1 of the flywheel 15 but smaller than the external diameter d2 of the flywheel 15, the disc plate 20 has multiple second positioning holes 22 corresponding to the first positioning holes 154, and the disc plate 20 is set on the outer periphery of the flywheel 15 by several bolts 21; also, the external diameter D2 of the disc plate 20 is larger than the external diameter d2 of the flywheel 15, and the external diameter D2 of the disc plate 20 is at least 1.5 times larger than the external diameter d2 of the flywheel 15; an area A full of magnetic resistance can be increased and the resistance is adjustable. In this embodiment, the disc plate 20 is fixedly screwed by a plurality of screws 21 to the flywheel 15 through a plurality of screw holes 22 thereon. Also, the fourth driving pulley wheel 14 is connected to the third pulley wheel 717 by a second belt 141 as shown in FIG. 3. Therefore, when the pedaling mechanism 71 is operated, the rotating element 13, the outer cap 18, the flywheel 15 and the disc plate 20 are able to be driven for rotation on the frame body 70 smoothly.

Figure 7:
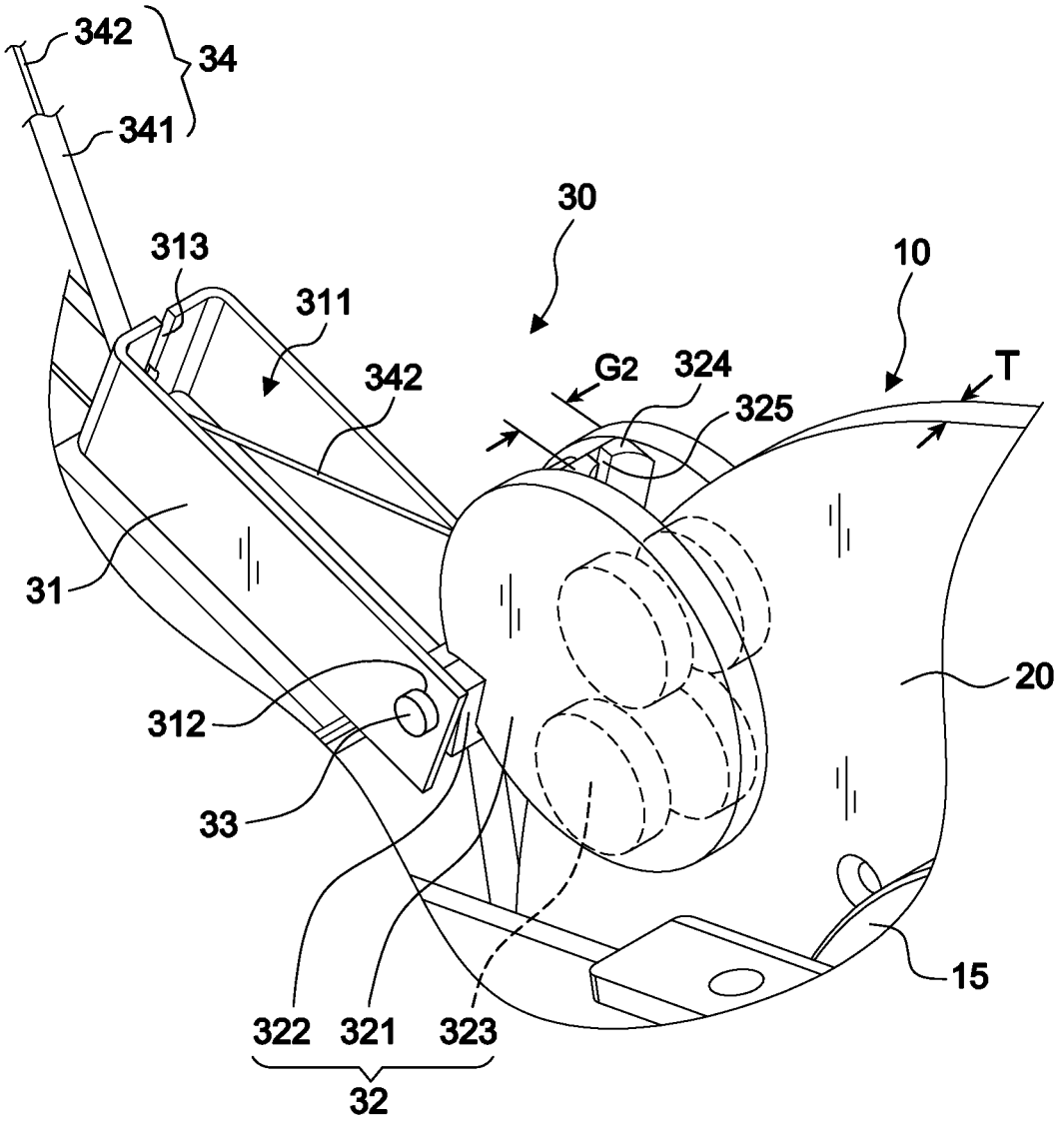
FIG. 7 is a perspective view of a magnetic resistance adjusting apparatus of the present invention.
Figure 8A:
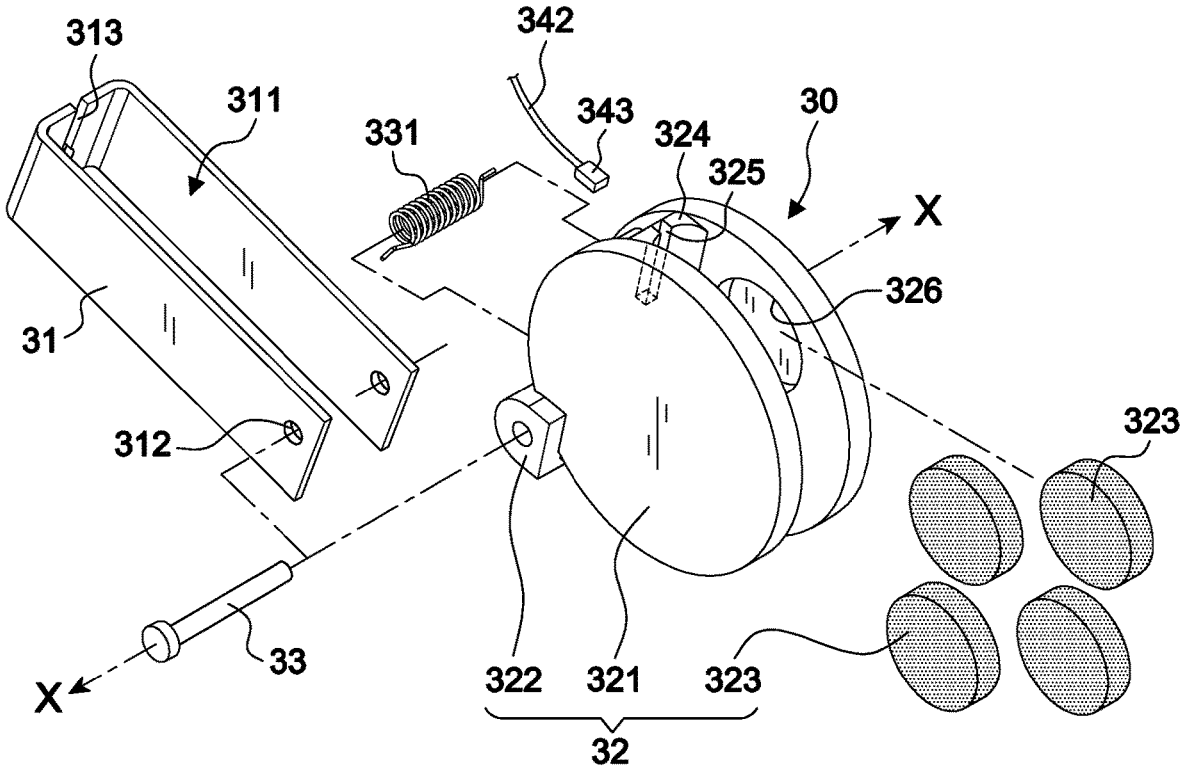
FIG. 8A is an exploded view of a pair of fixing plates and the components thereof according to the present invention.
Figure 8B:
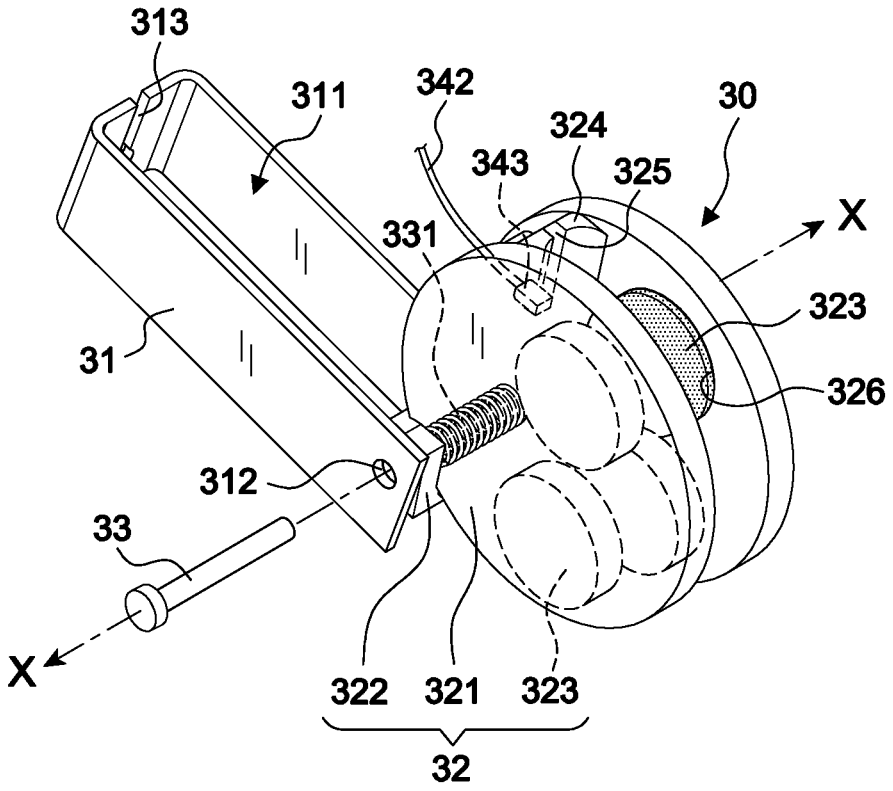
FIG. 8B is a perspective view of the pair of fixing plates of the present invention.
Figure 8C:
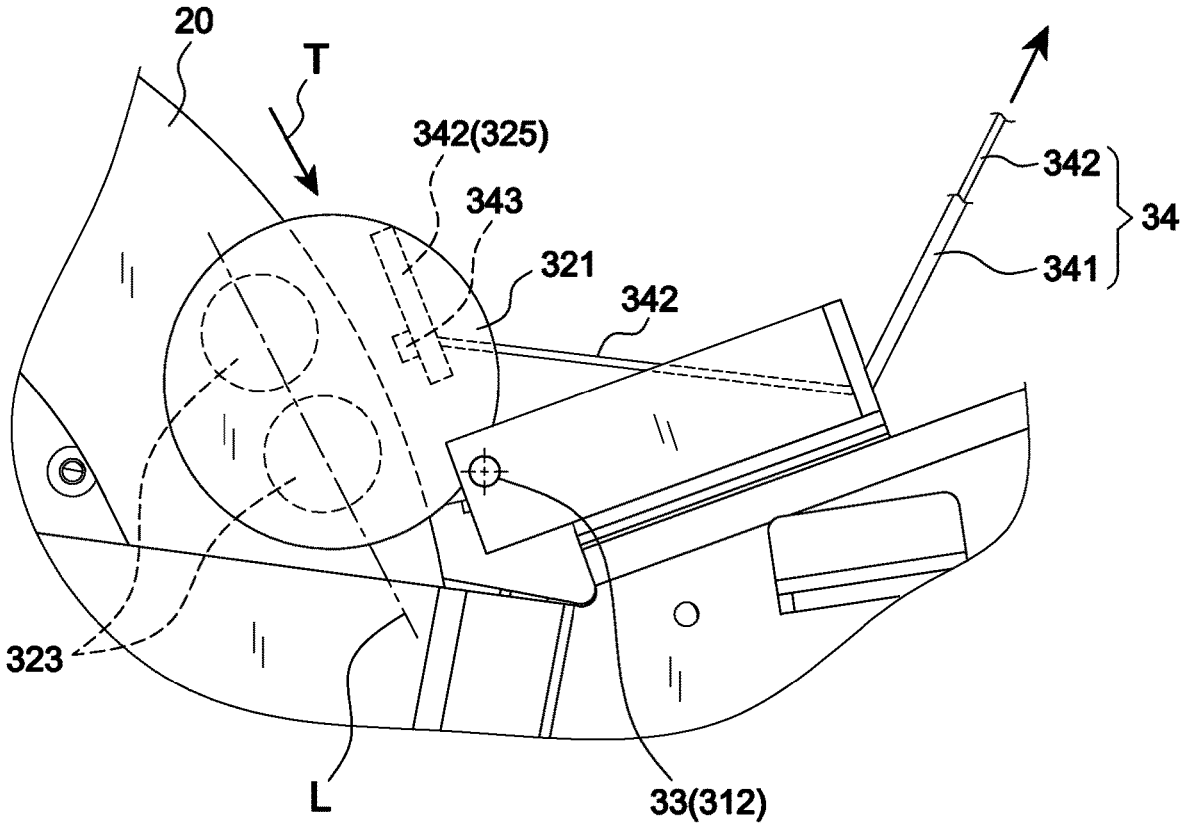
FIG. 8C is a schematic diagram illustrating the structure pair of fixing plates of the present invention during rotation.

The magnetic resistance adjusting apparatus 30 is disposed on the frame body 70 at a front side of the disc plate 20. Referring to FIGS. 5A, 5B, 7, 8A and 8B, the magnetic resistance adjusting apparatus 30 includes a positioning element 31 and a magnetically reluctant element 32. The positioning element 31 has a space 311 arranged therein, a spindle hole 312 arranged at a bottom thereof and a trench hole 313 at a top thereof. The magnetically reluctant element 32 has a pair of symmetrical fixing plates 321 fixed by a pivot element 322 and the fixing plates 321 are arranged in a gap G2 with a distance slightly greater than a thickness T of the disc plate 20 as shown in FIG. 7. The magnetically reluctant element 32 is fixed at the spindle hole 312 of the positioning element 31 by a positioning shaft 33 and each fixing plate 321 has at least one magnet 323 engaged at an inner side thereof. In this embodiment, the internal surface of the fixing plates 321 having two circular convex surfaces 326, two magnets 323 are arranged on both convex surfaces 326 for making the magnets 323 to be symmetric, as FIG. 8C showing, and the arrangement linear angle L of the magnets 323 are correspond to the tangent angle T of the disc plate 20 in order to achieve coupling effectively; in other words, the linear angle L and the tangent angle T are in same direction, when the magnetically reluctant element 32 is rotated to the lowest position, the pair of fixing plates 321 would be positioned at lateral sides of the disc plate 20, the disc plate 20 will be entirely coupled to maximize the magnetic force; when the magnetically reluctant element 32 is rotated to the highest position, the pair of fixing plates 321 would be separate from the disc plate 20; wherein a U shape fixing frame 324 arrange at the inner periphery of fixing plates 321, and the middle of the U shape fixing frame 324 has a slot 325 with upward opening; a pulling cable 34 including a cable 341 and a core wire 342 inside the cable 341, the front end of the cable 341 is positioned on the positioning element 31, the front end of the core wire 342 set through the trench hole 313 and connect to the rear side of the magnetically reluctant element 32, and a fixing block 343 is set in the slot 325 for pulling the magnetically reluctant element 32 to drive the pivot element 322 to rotate on the positioning shaft 33.

Figure 9:
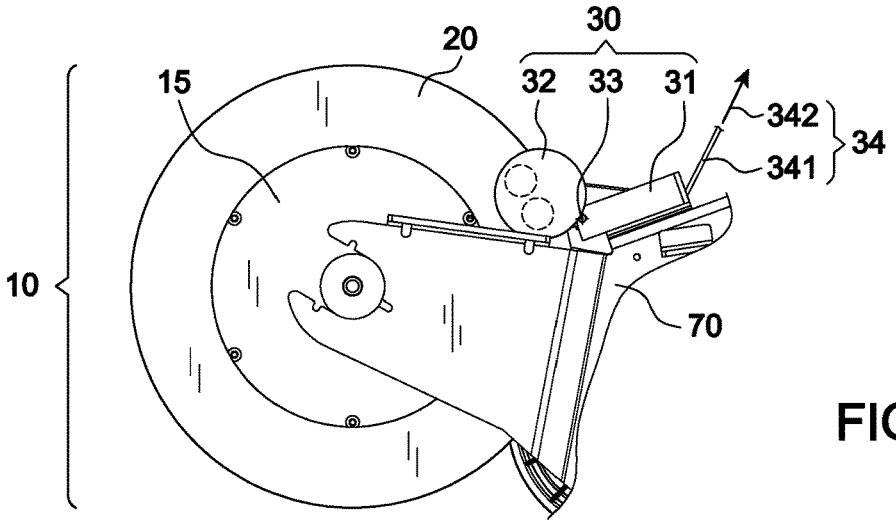
FIG. 9 is a schematic diagram illustrating operation of the magnetic resistance adjusting apparatus.
Figure 10:
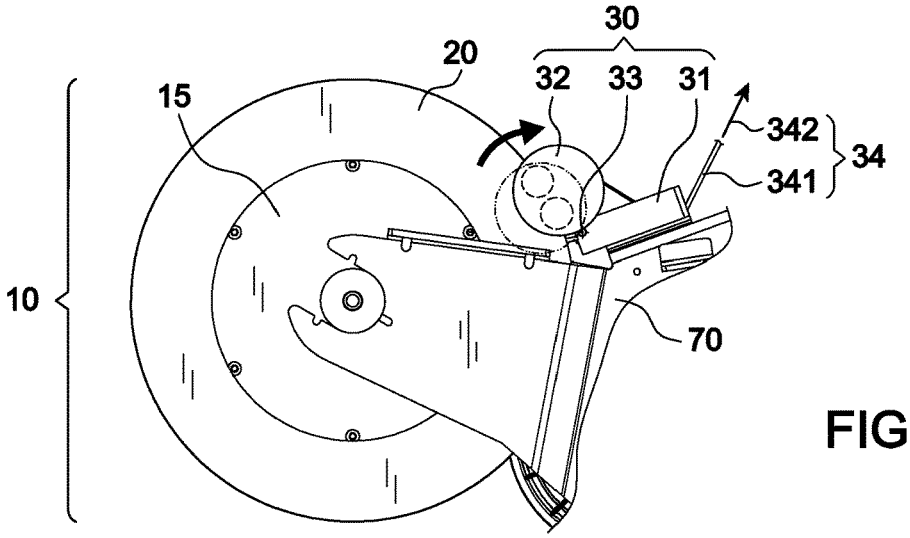
FIG. 10 is another schematic diagram illustrating operation of the magnetic resistance adjusting apparatus.
Figure 11:
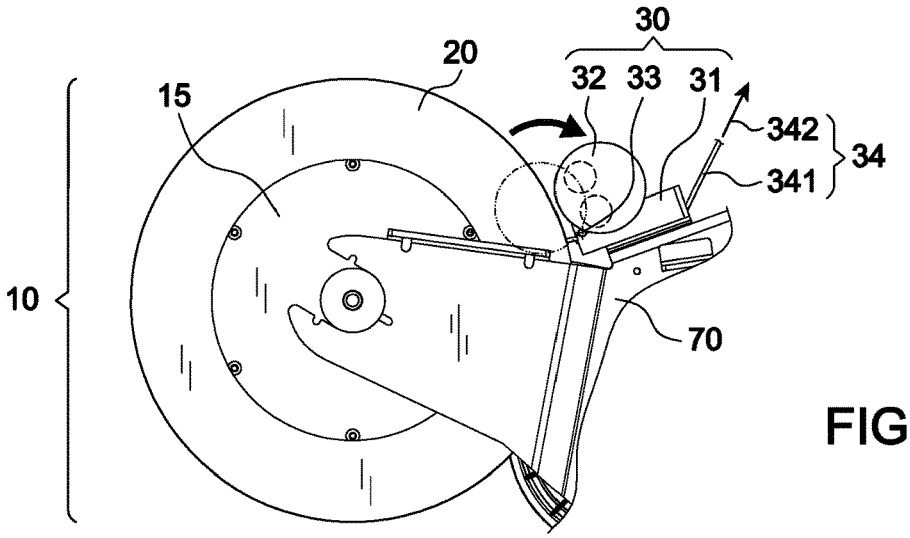
FIG. 11 is yet another schematic diagram illustrating operation of the magnetic resistance adjusting apparatus.

Furthermore, the magnetic resistance adjusting apparatus 30 further includes a pulling cable 34 which has an inner cable 342 arranged inside a cable sheath 341. The cable sheath 341 has a front end thereof connected to the positioning element 31 and the inner cable 342 has a front end thereof stretching out from the cable sheath 341 and connected to a lateral side of the magnetically reluctant element 32 by a fixing block 343. The operation of the present invention is activated by the pulling cable 34. Referring to FIGS. 9-11, the magnetic flux of the magnets 323 inside the pair of fixing plates 32 covers both side of the disc plate 20 laterally when the pulling cable 34 is not operated and a loading resistance at a maximum value is produced; the magnetic flux of the magnets 323 of the fixing plates 32 departs from the disc plate 20 gradually and the loading resistance decreases gradually until the fixing plates 32 leaves the disc plate 20 completely and the resistance returning to zero when the pulling cable 34 is operated. A spring element 331 is engaged outside the positioning shaft 33 of the magnetic resistance adjusting apparatus 30 as shown in FIGS. 8A and 8B. When the pulling cable 34 is operated, the magnetically reluctant element 32 rotates pivotally in a clockwise direction around the positioning shaft 33 and sinks into the space 311 of the positioning element 31, and the spring element 331 is twisted and a torque thereof is restored. When the pulling cable 34 is released for loosening, the magnetically reluctant element 32 returns pivotally in a counterclockwise direction due to releasing of the torque force from the spring element 331.

Figure 12:
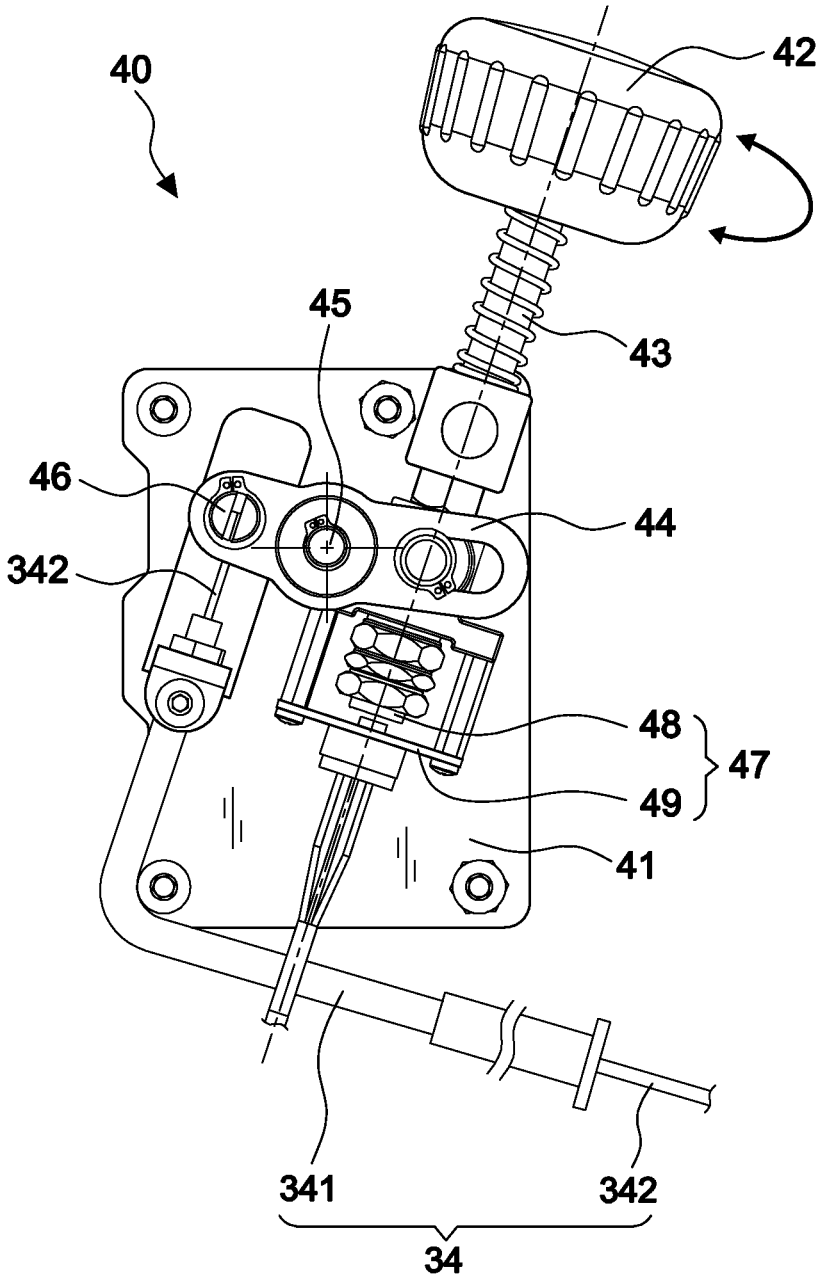
FIG. 12 is a schematic diagram illustrating a structure of a resistance adjusting apparatus of the present invention.
Figure 13:
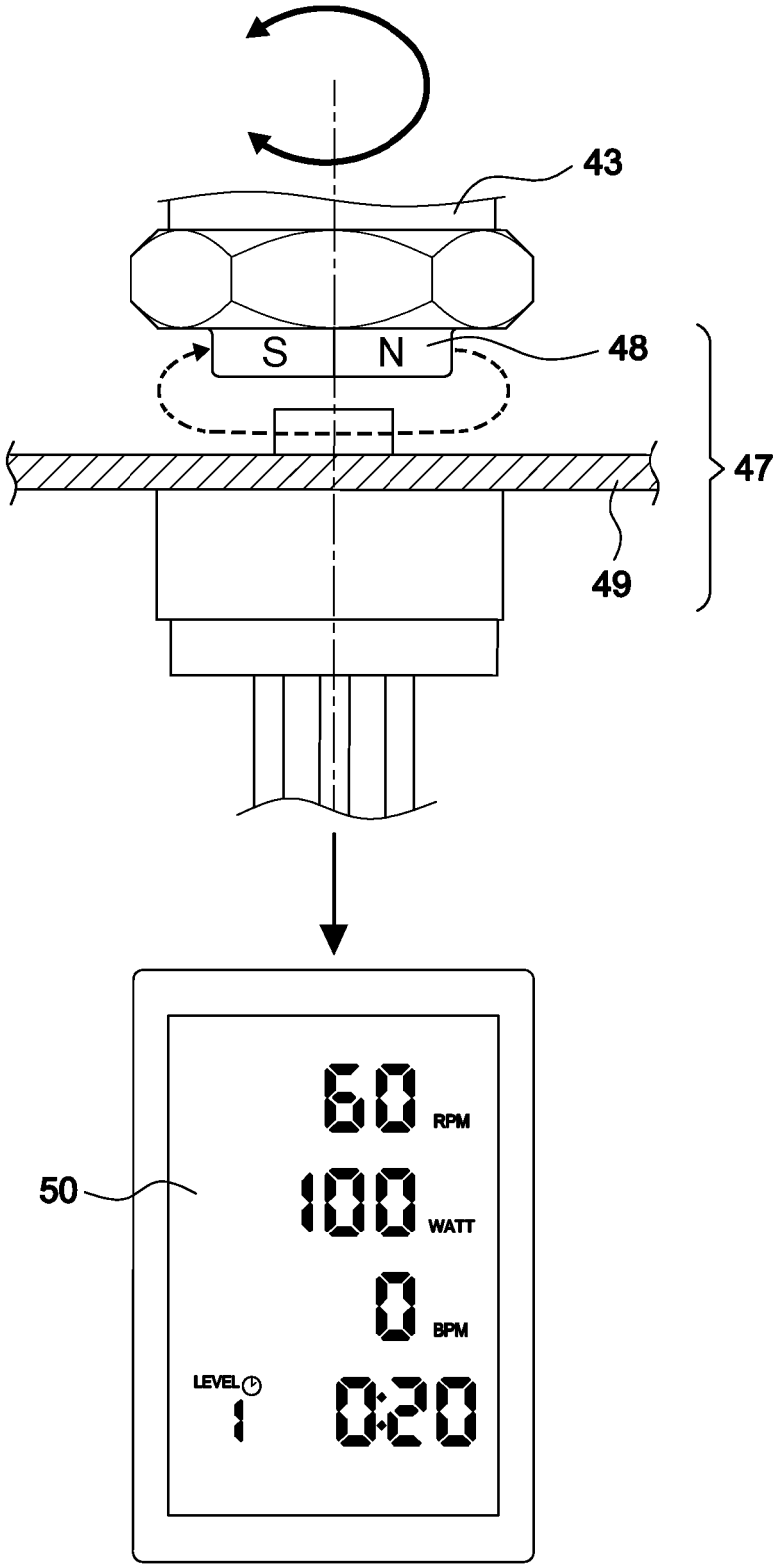
FIG. 13 is a schematic diagram illustrating a loading resistance being detected and converted to an interface according to the present invention.

With reference to FIG. 12, in this embodiment, the resistance adjusting apparatus 40 includes a case body 41 disposed at a front end of the frame body 70, a rotatable button 42 disposed in the case body 41, an operating rod 43 connected to the button 42 and an operating piece 44 having a center pivotally engaged to the case body 41 by a pivot shaft 45, an end pivotally engaged to the operating rod 43 and the other end pivotally engaged to an operating rod 46. A rear end of the inner cable 341 is also fixedly tied up to the connecting rod 46; thereby the button 42 is rotated clockwise to lower the operating rod 43 and the operating piece 44 is operated based on the pivot shaft 45 to elevate the connecting rod 46 for operating the pulling cable 34. If the button 42 is rotated counter-clockwise, the operating rod 43 is elevated and the operating piece 44 is operated to lower the connecting rod 46 for loosening the pulling cable 34. Moreover, a magnetic encoder 47 with a magnet 48 is further disposed at a bottom of the operating rod 43, and a printed circuit board (PCB) 49 with an encoding circuit is disposed below the magnet 48, so that the PCB 49 is able to detect a rotation angle of the magnet 48 and convert it into a value of loading resistance displayed on the interface 50 as shown in FIG. 13.

Whereby the pedaling mechanism 71 is operated to rotate the rotating element 13 for the flywheel 15 and the disc plate 20 to be driven for rotation and for the electricity generator 10 to produce electricity, and the button 42 is rotated for the connecting rod 46 of the resistance adjusting apparatus 40 to operate the pulling cable 34 for the purpose of altering coverage area of magnetic flux produced by the operation and therefore adjusting a loading resistance of the spinner bike.

With the structures disclosed above, the magnetic resistance adjusting apparatus 30 has magnetic flux produced to cover the disc plate 20 and to form resistance for the pedaling mechanism 71 of the spinner bike. By altering the coverage area of the magnetic flux on the disc plate 20, the magnetic resistance can be adjusted as needed. Furthermore, as the magnetically reluctant element 32 is pivotally rotated between the position around the disc plate 20 and the space 311 of the positioning element 31 by operation of the pulling cable 34, the magnetic resistance is thereby increased to the maximum value and reduced to the minimum value, i.e., zero resistance. The present invention therefore is able to perform a smooth adjusting process of the magnetic resistance produced by the operation between the maximum and the minimum. Moreover, the magnetic encoder 47 is able to further display the number of the resistance as a loading force on the interface 50 by converting the data of the rotation angle of the magnet 48 thereof, so that users of the spinner bike can obtain the information during exercising instantly and achieve better efficiency of the workout.

Therefore, the present invention is combined with electricity generator 10, disc plate 20, magnetic resistance adjusting apparatus 30 and resistance adjusting apparatus 40, each of these components are indispensable and complement each other; despite there are part of device are disclosed in prior art of the applicant, the present invention design a combination which never been disclosed, and it is nonobvious and achieve patentability. Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A spinner bike with adjustable magnetic resistance, comprising:

a frame body including a pedaling mechanism and a handler bar;

an electricity generator disposed at a rear side of said frame body, including a fixing element, a circular armature core surrounding said fixing element, a rotating element having an axis engaging a fourth pulley wheel and an axial seat engaging in a sleeve bush of a flywheel and a plurality of magnets disposed in an inner depression of said flywheel and surrounding said armature core, a gap arranged between said plurality of magnets and said armature core, so that when the flywheel is driven to rotate by the rotating element, the magnets and the armature core would produce electricity due to operation of cutting-of-flux; wherein an outer periphery of the flywheel has an inner external diameter and an outer external diameter to form an annular positioning surface, and the annular positioning surface has multiple first positioning holes;

a disc plate made of magnetically conductive metal and disposed around the outer periphery of said flywheel to be rotated together with said flywheel; wherein an inner diameter of the disc plate is larger or equal to the inner external diameter of the flywheel but smaller than the outer external diameter of the flywheel, the disc plate has multiple second positioning holes corresponding to the first positioning holes, and the disc plate is set on the outer periphery of the flywheel by several bolts; also, an external diameter of the disc plate is larger than the outer external diameter of the flywheel, and the external diameter of the disc plate is at least 1.5 times larger than the outer external diameter of the flywheel;

a magnetic resistance adjusting apparatus disposed on said frame body at a front side of said disc plate, including a positioning element with a space arranged therein, a spindle hole arranged at a bottom thereof and a trench hole at a top thereof, a magnetically reluctant element fixed at a bottom of said positioning element by a positioning shaft and having a pair of symmetrical fixing plates positioned by a pivot element at the bottom, said pair of fixing plates arranged in a gap with a distance slightly greater than a thickness of said disc plate, each fixing plate having at least two magnets engaged at an inner side thereof;

wherein an internal surface of the fixing plates having two circular convex surfaces, two magnets are arranged on both convex surfaces for making the magnets to be symmetric, and the arrangement linear angle of the magnets are correspond to a tangent angle of the disc plate in order to achieve coupling effectively; when the magnetically reluctant element is rotated to the lowest position, the pair of fixing plates would be positioned at lateral sides of the disc plate; when the magnetically reluctant element is rotated to the highest position, the pair of fixing plates would be separate from the disc plate;

wherein a U shape fixing frame arrange at an inner periphery of fixing plates, and the middle of the U shape fixing frame has a slot with upward opening;

wherein a pulling cable including a cable and a core wire inside the cable, a front end of the cable is positioned on the positioning element, a front end of the core wire set through the trench hole and connect to a rear side of the magnetically reluctant element, and a fixing block is set in the slot for pulling the magnetically reluctant element to drive the pivot element to rotate on the positioning shaft; moreover, at an outer periphery of the positioning shaft of the magnetic resistance adjusting apparatus has a spring element; thereby an magnetic flux of said magnets inside the pair of fixing plates would cover both side of the disc plate laterally when the pulling cable is not operated and a loading resistance at a maximum value is produced, and the magnetic flux of said magnets of the fixing plates would depart from the disc plate gradually and the loading resistance decreases gradually until returning to zero when the pulling cable is operated; and a resistance adjusting apparatus including a case body disposed at a front end of said frame body, a rotatable button, an operating rod connected to said button and an operating piece having a center thereof pivotally engaged to said case body by a pivot shaft and an end thereof pivotally engaged to the operating rod, a rear end of said inner cable of the pulling cable further fixedly tied up to a connecting rod, thereby the button is rotated to control the operating piece operated based on the pivot shaft and further have the connected rod operating the pulling cable for operation;

whereby the pedaling mechanism is operated to rotate the rotating element for the flywheel and the disc plate to be driven for rotation and for the electricity generator to produce electricity, and the button is rotated for the connecting rod of the resistance adjusting apparatus to operate the pulling cable for the purpose of altering coverage area of magnetic flux produced by the operation and therefore adjusting a loading resistance of the spinner bike.

2. The spinner bike with adjustable magnetic resistance as claimed in claim 1, wherein an interface is further installed on the handler bar and has electricity supply from the electricity generator.

3. The spinner bike with adjustable magnetic resistance as claimed in claim 2, wherein a magnetic encoder with a magnet is further disposed at a bottom of the operating rod and a printed circuit board with an encoding circuit is disposed below the magnet of the magnetic encoder, so that the printed circuit board is able to detect a rotation angle of the magnet of the magnet encoder and convert the rotation angle into a value of loading resistance displayed on the interface.

4. The spinner bike with adjustable magnetic resistance as claimed in claim 1, wherein the spring element is engaged outside the positioning shaft of the magnetic resistance adjusting apparatus so that when the connecting rod is operated and the pulling cable is driven thereby, the magnetically reluctant element rotates in a clockwise direction around the positioning shaft, and when the connecting rod release an operational force on the pulling cable, the magnetically reluctant element therefore returns in a counter clockwise direction due to a torque force of the spring element.

* * * * *